US010274188B2

(12) United States Patent
Sculler

(10) Patent No.: US 10,274,188 B2
(45) Date of Patent: Apr. 30, 2019

(54) LANTERN WITH HEATER

(71) Applicant: Twin-Star International, Inc., Delray Beach, FL (US)

(72) Inventor: Marc Sculler, Delray Beach, FL (US)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 0 days.

(21) Appl. No.: 15/096,700

(22) Filed: Apr. 12, 2016

(65) Prior Publication Data

US 2017/0122550 A1 May 4, 2017

Related U.S. Application Data

(60) Provisional application No. 62/250,621, filed on Nov. 4, 2015.

(51) Int. Cl.

| | |
|---|---|
| ***F21S 6/00*** | (2006.01) |
| ***F21V 33/00*** | (2006.01) |
| ***F21V 11/08*** | (2006.01) |
| ***F24H 3/02*** | (2006.01) |
| ***F24H 9/02*** | (2006.01) |
| *F21V 21/08* | (2006.01) |
| *F21W 121/00* | (2006.01) |
| *F21Y 115/10* | (2016.01) |

(52) U.S. Cl.

CPC ..... *F21V 33/0028* (2013.01); *F21S 6/001* (2013.01); *F21V 11/08* (2013.01); *F24H 3/022* (2013.01); *F24H 9/02* (2013.01); *F21V 21/0832* (2013.01); *F21W 2121/00* (2013.01); *F21Y 2115/10* (2016.08)

(58) Field of Classification Search

CPC ..... F21V 15/01; F21V 17/18; F21V 33/0092; F21S 9/037; F21S 6/001–6/003; F21S 13/12; F21L 4/04; F21L 4/08; A61L 2209/12

See application file for complete search history.

(56) References Cited

U.S. PATENT DOCUMENTS

| | | | | |
|---|---|---|---|---|
| 3,890,085 A * | 6/1975 | Andeweg | F21S 6/001 | 362/161 |
| 7,204,618 B1 * | 4/2007 | Kuelbs | F21S 9/037 | 362/35 |
| 8,632,234 B1 * | 1/2014 | Lowe | F21S 8/081 | 362/153.1 |

(Continued)

*Primary Examiner* — Anh T Mai
*Assistant Examiner* — Steven Y Horikoshi
(74) *Attorney, Agent, or Firm* — McDonald Hopkins LLC

(57) ABSTRACT

A lantern comprises a light source configured to emit visible light, as well as a heater configured to emit heat separate from the visible light of the light source. The lantern may have a housing defining a lighting section and a heating section, with the lighting section being arranged above the heating section. The light source may be positioned in the lighting section, or the light source may be positioned outside of the lighting section and adapted to project visible light at least partially into the lighting section, such as from a base below the lighting section or from a top above the lighting section. The heating section may contain the heater, which may be a convection heater adapted to blow heated air out of the housing in a desired direction. The housing may include a suspension structure for supporting the lantern.

13 Claims, 10 Drawing Sheets

(56) References Cited

U.S. PATENT DOCUMENTS

| | | | | |
|---|---|---|---|---|
| 2002/0023636 | A1* | 2/2002 | Ashton | F21H 1/00 126/92 B |
| 2006/0087852 | A1* | 4/2006 | Richmond | F21S 9/037 362/374 |
| 2009/0180767 | A1* | 7/2009 | Byrne | F21S 6/002 392/471 |
| 2010/0254134 | A1* | 10/2010 | McCanless | F21S 8/088 362/235 |
| 2013/0176741 | A1* | 7/2013 | Nakamura | F21V 13/12 362/347 |
| 2013/0235566 | A1* | 9/2013 | Fan | F21V 13/045 362/187 |
| 2015/0009660 | A1* | 1/2015 | Lee | F21L 4/00 362/186 |

* cited by examiner

LANTERN WITH HEATER

CROSS-REFERENCE TO RELATED APPLICATIONS

This application claims the benefit of the filing date of U.S. Provisional Patent Application No. 62/250,621 filed Nov. 4, 2015, the disclosure of which is hereby incorporated herein by reference.

BACKGROUND OF THE INVENTION

Lanterns, both for providing illumination and for decorative purposes, are well known. In general, lanterns include a housing enclosing a light source. Many different light sources have been used in lanterns over the years. Additionally, lantern housing designs have varied quite a bit, for aesthetic reasons as well as functional reasons. For example, some lanterns are designed to be portable, and to provide light in places that may not include artificial lighting (e.g., campsites). Other lanterns are designed to have an aesthetic appearance that a user would select to decorate a particular outdoor or indoor location where the lantern will be placed, sometimes by attaching the lantern to a structural component in the location. Such decorative lanterns may function as light sources, but not necessarily.

Despite many variations and improvements over the years in lantern designs, still further improvement would be desirable.

BRIEF SUMMARY OF THE INVENTION

One aspect of the present invention provides a lantern. The lantern according to this aspect of the invention may include a light source, a heater, and a housing. The light source is desirably configured to emit visible light, and the heater is desirably configured to emit heat separate from the visible light of the light source. Desirably, the housing includes a top and a base, and the housing defines an interior volume. The housing may be configured to permit visible light from the light source and heat generated by the heater to emanate from the housing.

According to another aspect of the invention, the housing may define a lighting section and a heating section. The heating section may contain the heater, and the lighting section may be adapted to be at least partially illuminated by visible light emitted by the light source. The lighting section may be arranged above the heating section, and the heating section may be located in the base. The heating section may be adapted to direct heat from the heater outward from the lantern in a desired direction. For example, the heater may be a convection heater adapted to blow heated air in that desired direction. The lighting section of the housing may include at least one aperture to permit visible light from the light source to emanate from the interior volume of the housing. The aperture may be defined by at least two support posts extending between the base and the top of the housing, and the aperture may include a translucent panel.

According to other aspects of the invention, the light source may be positioned within the lighting section of the housing. For example, the light source may be an artificial candle positioned within the lighting section and configured to be illuminated by electric power. According to yet other aspects of the invention, the light source may be positioned outside of the lighting section of the housing. In such aspects, the light source may be adapted to project visible light at least partially into the lighting section. For example, the light source may be positioned in the base of the housing and adapted to illuminate at least a portion of the lighting section from below. In another example, the light source may be positioned in the top of the housing and adapted to project the visible light downwardly. In such an example, the light source may be adapted to at least partially illuminate a region outside of the housing. In yet further aspects of the invention, the lantern may include multiple light sources within and/or outside of the lighting section, such as by combining multiple ones of the exemplary lighting source positions discussed above.

Another aspect of the present invention provides a lantern. The lantern according to this aspect of the invention may include a housing, a heater, and a light source. The housing desirably has a base section and a lighting section, with the lighting section preferably being arranged above the base section. Desirably, the heater is arranged within the base section, and the light source is arranged within the housing so as to be adapted to emit visible light through the lighting section.

Yet another aspect of the present invention provides a lantern. The lantern according to this aspect of the invention may include a housing, a heater, and a light source. The housing desirably has a base section and a lighting section, with the lighting section preferably being arranged above the base section. Desirably, the heater is arranged within the base section, and the light source is arranged within the lighting section. The light source may be adapted to emit visible light sufficient to illuminate a desired area outside of the housing.

According to some aspects of the invention, a suspension structure may be coupled to the housing, such as at the top of the housing. The suspension structure may be configured to support the lantern by suspending the lantern from the suspension structure. Alternatively, the suspension structure may be purely decorative, and may be simply designed to look like analogous structures in other lanterns.

DETAILED DESCRIPTION

Figure 1:
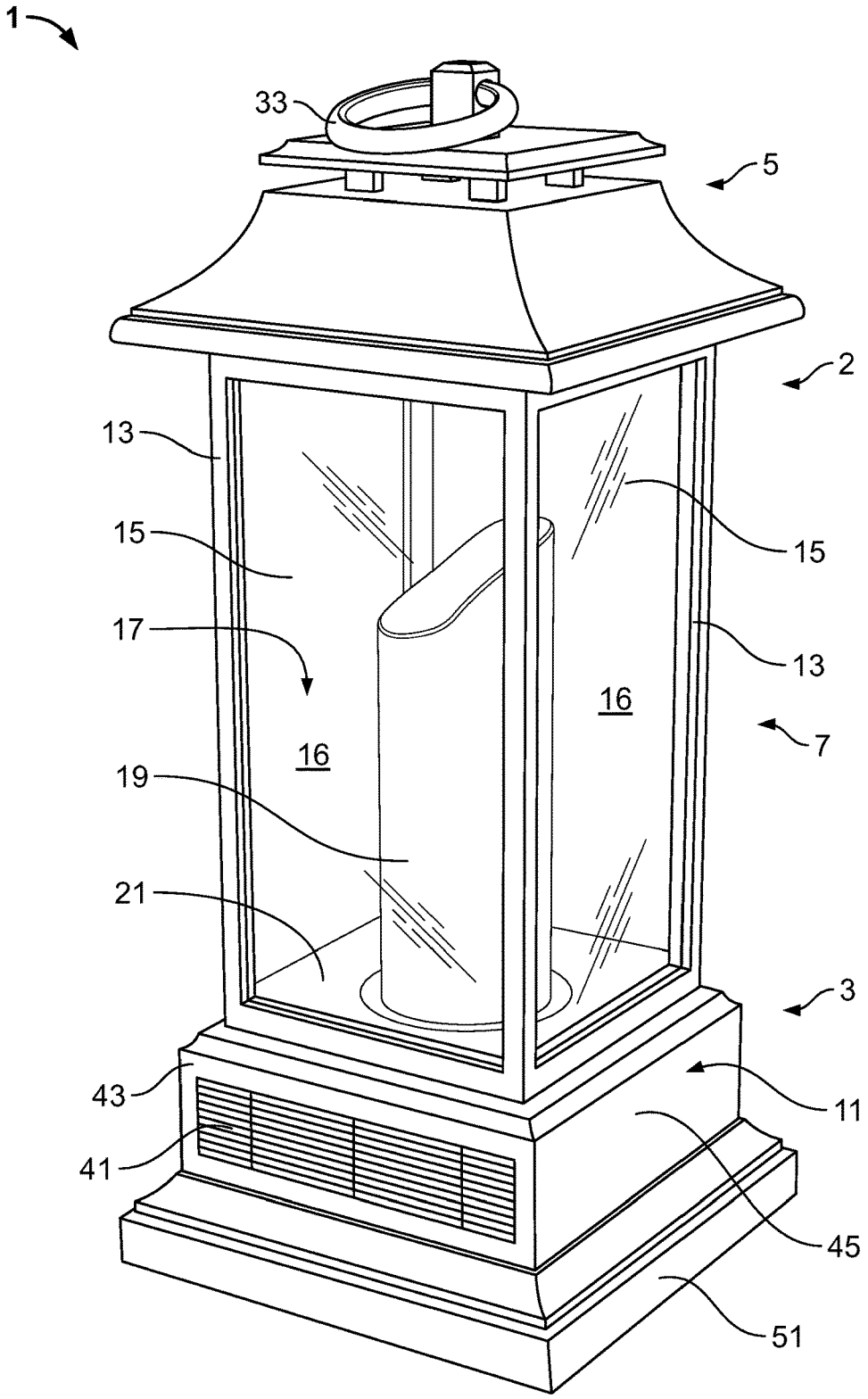
FIG. 1 is a front perspective view of a lantern, in accordance with an embodiment of the present invention.

A lantern 1 in accordance with a first embodiment of the present invention includes a housing 2 comprising a base 3, a top 5, and a lighting section 7 disposed therebetween. The lantern also includes a heater 9 (see FIGS. 6-7). The heater 9 is desirably positioned in a heating section 11 of the housing 2. In the embodiment depicted in FIGS. 1-10, the heating section 11 is positioned below the lighting section 7, and, as shown, it can also be incorporated into the base 3 of the lantern. In other embodiments (not shown), however, the heating section 11 may be positioned above the lighting section 7. For example, it may be positioned between the lighting section 7 and the top 5, or it may be incorporated into the top 5.

The lighting section 7 may include a plurality of support posts 13 extending between the base 3 and the top 5, and defining apertures 15 therebetween. The apertures 15 may be empty, or at least somewhat translucent or transparent structures, such as clear glass window panes 16, may be positioned in one or more of the apertures 15. The support posts 13 are desirably arranged around the longitudinal axis of the lantern 1 so as to define an interior volume 17 therein. One or more light sources may be positioned in the interior volume 17 of the lighting section 7. The light sources are desirably configured to emit primarily visible light. Such light sources may include light emitting diodes (LEDs), incandescent light bulbs, fluorescent light bulbs, halogen light bulbs, or any other suitable source of electrically powered light. Other suitable light sources may include those powered by gas or liquid fuel, such as natural gas, propane, oil, gasoline, kerosene, etc., or even solid-based fuels, like wax candles. In the embodiment illustrated in FIG. 1, the interior volume 17 of the lighting section 7 includes an artificial candle 19 in the form of an at least somewhat translucent, cylindrical, polymer column having one or more light sources, such as LEDs, within it for illuminating the candle 19. The artificial candle 19 may include real or artificial wax accumulations 20 (see FIG. 3) along the outer surface thereof, to replicate a real candle which has been partially consumed.

Figure 2:
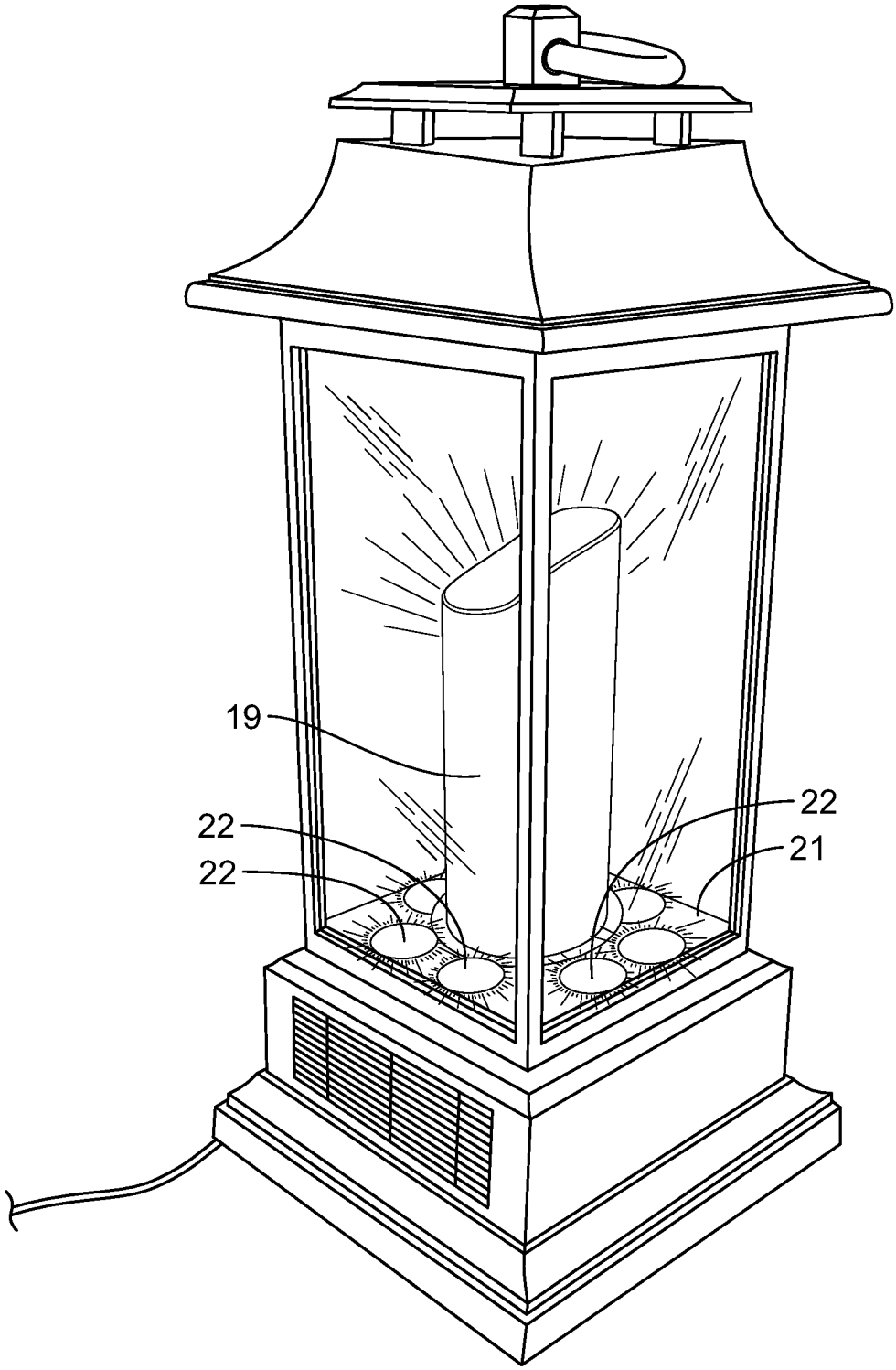
FIG. 2 is a perspective view of the lantern of FIG. 1, showing various light sources illuminated.
Figure 3:
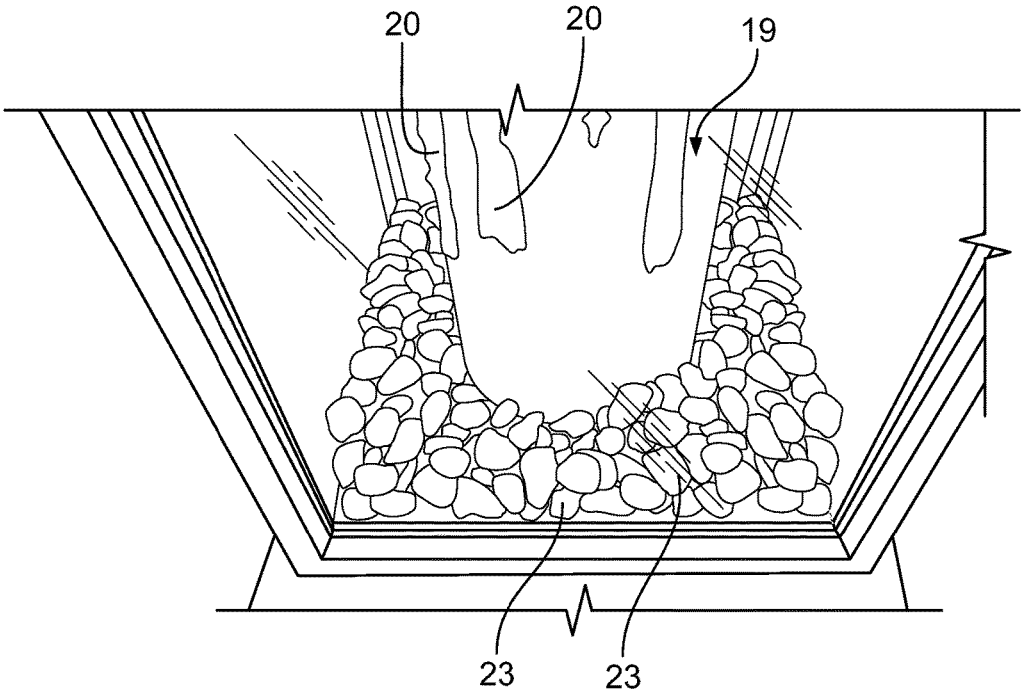
FIG. 3 is an enlarged perspective view of the bottom of the lighting section of the lantern of FIG. 1 underside of the top of the lantern of FIG. 1.

Light sources are not limited to being within the interior volume 17 of the lighting section 7. For example, all or a portion of a wall 21 defining the bottom of the lighting section 7 may be at least somewhat translucent, such that the wall 21 can transmit light from one or more light sources positioned below the wall. For example, a plurality of lights 22 (e.g., LEDs) may be positioned below the wall 21 around the base of the candle 19, as shown in FIG. 2. Such light sources may illuminate part of the interior volume 17 of the lighting section 7, and those light sources may be provided in addition to or in lieu of those in the interior volume 17 itself (e.g., in the candle 19). Moreover, items may be positioned for decorative effect within the interior volume 17, along the bottom wall 21, as shown in FIG. 3. For example, rocks 23 or clear or colored glass pieces may be placed on the wall 21 around the base of the candle 19. Positioning such items in that manner may also add to the visual interest of the light emitted by the lantern 1, particularly if light sources are provided below the wall 21 defining the bottom of the lighting section 7, as light from such sources may be filtered through the items positioned along the bottom wall 21, as shown in FIG. 3.

Figure 4:
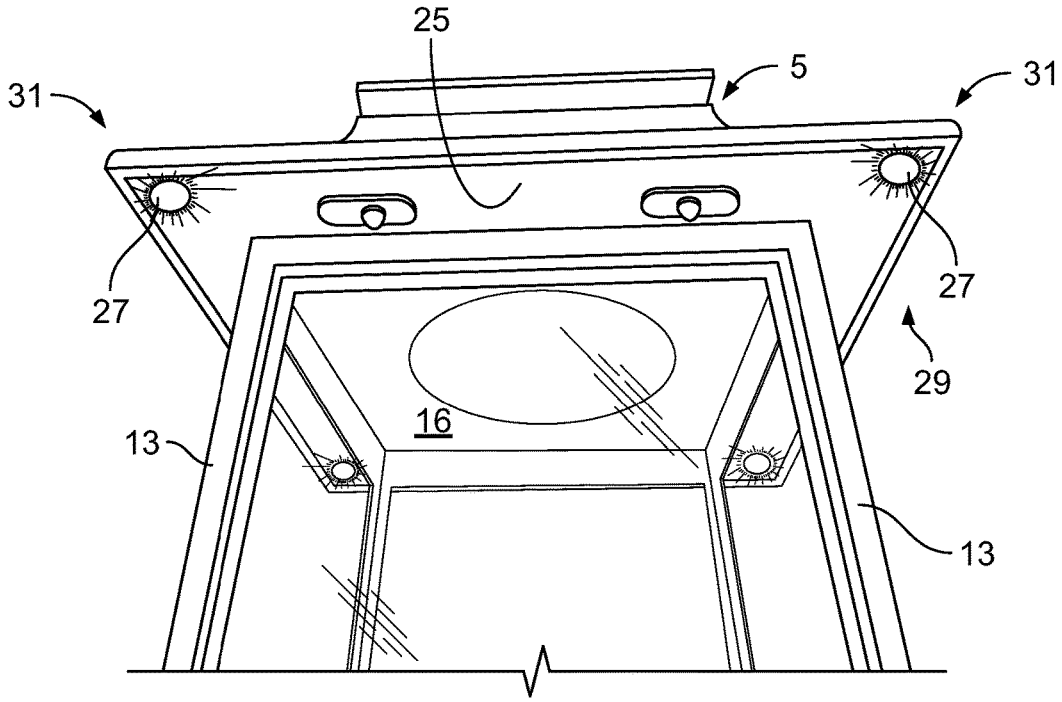
FIG. 4 is an enlarged perspective view of the underside of the top of the lantern of FIG. 1.

Another possible location for light sources outside of the lighting section 7 is in the top 5. For example, as shown in FIG. 4, the underside 25 of the top 5 may include one or more lights 27 projected at least partially downwardly towards the base 3 of the lantern 1. Such lights 27 may be arranged to illuminate part of the interior volume 17 of the lighting section 7. Additionally, or alternatively, such lights 25 in the top 5 of the lantern 1 may be oriented at least partially outwardly away from the interior volume 17 of the lighting section 7, so as to illuminate regions outside of the lantern. Moreover, the lights 27 in the top 5 may be provided in addition to or in lieu of those in the candle 19 and/or the lights 22 below the bottom wall 21 of the lighting section 7. The top 5 may be designed to extend outwardly from the support posts 13, so as to define an overhanging portion 29. The lights 27 in the top 5 may be located in the overhanging portion 29, such as in each corner 31 of the overhanging portion 29.

Figure 6:
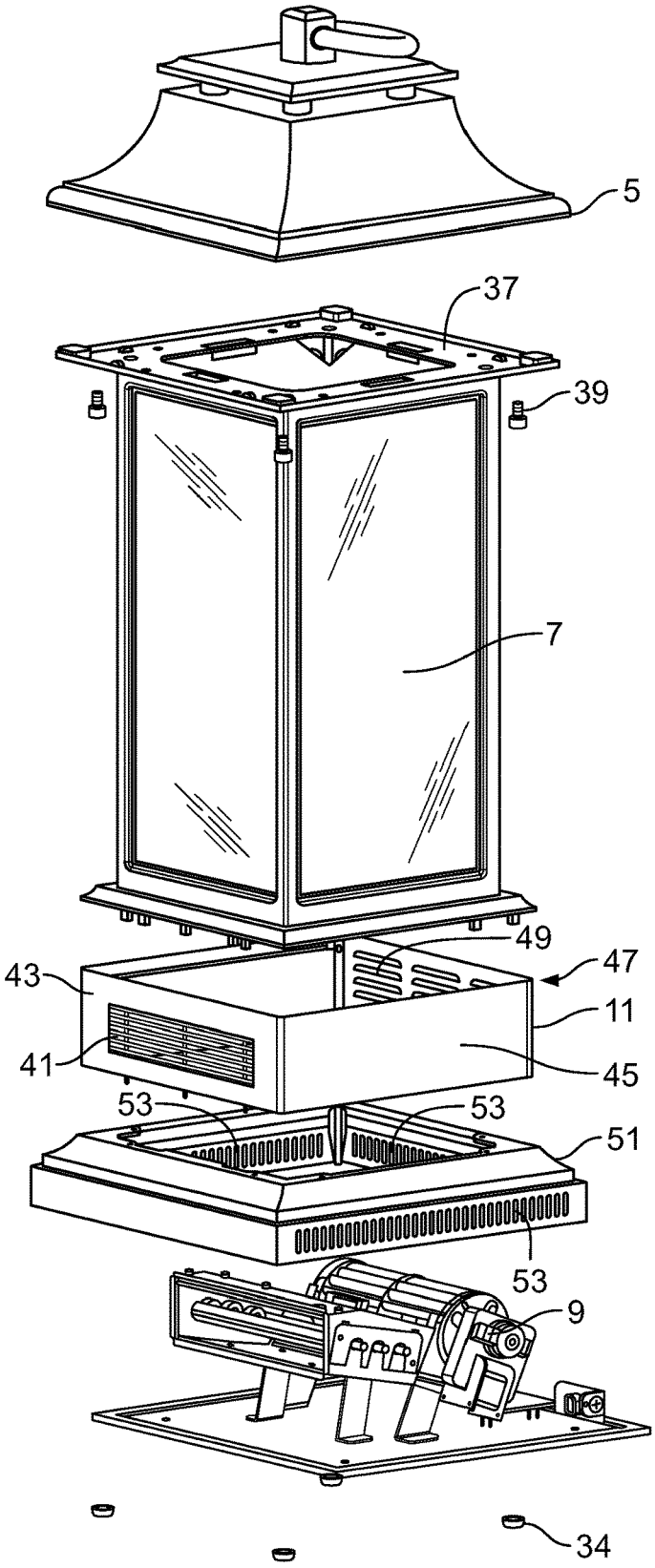
FIG. 6 is an exploded view of the lantern of FIG. 1.

The top of the lantern 1 may include a suspension structure. In some embodiments, the suspension structure is configured to support the lantern 1 by suspending it from the suspension structure. For example, in the embodiment of FIG. 1, the suspension structure may be in the form of a ring 33 designed to support the weight of the lantern 1 and configured to be engaged by a supporting structure, such as a chain, a bracket, or a support arm fixed to another structure. In other embodiments, the suspension structure may be designed to be supported by a user grasping the suspension structure in the user's hand. In such embodiments, the suspension structure may be in the form of a handle, which may be ergonomically designed to conform to at least a portion of the user's hand. In other embodiments, the suspension structure may be purely decorative, and may be simply designed to look like analogous structures in other lanterns. Moreover, whether or not a suspension structure is provided, the base 3 of the lantern 1 may also be designed to sit on a substantially horizontal supporting surface. Therefore, the base 3 may additionally include structures (e.g., rubber pads 34, as shown in FIG. 6) configured to contact the substantially horizontal supporting surface while protecting the surface and creating non-skid points of contact.

Figure 5:
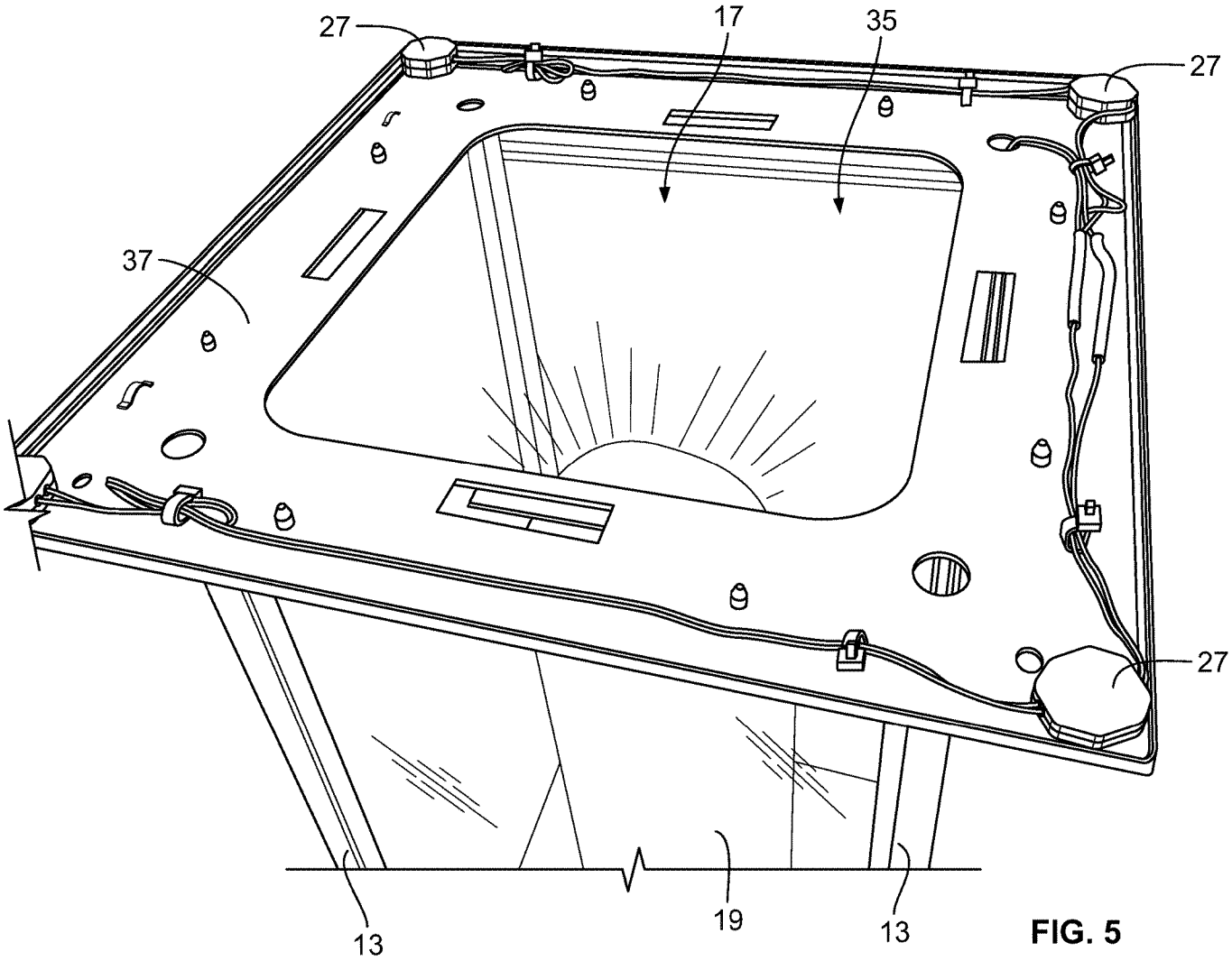
FIG. 5 is an enlarged perspective view of the top portion of the lighting section of the lantern of FIG. 1, with the top of the lantern removed.

The top 5 of the lantern 1 may be connected to the lighting section 7 in such a way that an opening 35 can be selectively exposed in order to access the interior volume 17 of the lighting section 7, as shown in FIG. 5. For example, the top 5 may sit on a frame 37 that connects the tops of the support posts 13. The top 5 may be removably attached to the frame 37 by screws 39, as shown in FIG. 6. That way, by removing the screws 39 and lifting the top 5, the opening 35 defined within the frame 31 can be exposed. Alternatively, the top 5 may be connected to the frame 37 by one or more latches or hooks. The top 5 may also be attached to the frame 37 by one or more hinges, so that the top 5 can be pivoted to expose the opening 35. The one or more hinges may be used in addition to other attachment structures as identified above. For example, one or more hinges may connect the top 5 to the frame 31 along one side of the frame 31, and one or more of the other sides of the frame 31 (e.g., the side of the frame 31 opposite to the one or more hinges) may be attached to the top by one or more screws 39, latches, or hooks. Additionally, or alternatively, access to the interior volume 17 may be provided by making one or more of the window panes 16 removable, or by attaching it to an adjacent support post 13 with a hinge so that the window can be pivoted open. Providing access to the interior volume 17 in such manner, e.g., via opening 35, may allow for one or more of the light sources in the interior volume 17 to be replaced or replenished. Moreover, it may allow a user to position or replace decorative items within the interior volume 17, such as the rocks 23 discussed above.

As discussed above, the lantern 1 may include a heater 9 disposed in a heating section 11. Desirably, such heater 9 is configured to supply sufficient heating energy to the area and/or people located around the lantern 1 to provide a pleasant warmth to that area and/or people. In one example, the heater 9 may be a convection heater that blows heated air out of one or more openings in the lantern 1. The opening may be in the form of a grill 41 on the front face 43 of the lantern 1. Similar openings, including grills, may be provided on one or more side faces 45 or the rear face 47 of the lantern 1, and the heater 9 may be configured to direct heat out of one or more of such other openings as well. Other openings, which may also be in the form of grills, may be provided as inlets for permitting supply air to enter the heater 9 to be heated. For example, in the embodiment illustrated in FIGS. 1-10, the rear face 47 of the lantern 1 includes a grill 49 serving as an air inlet for the heater 9. A skirt 51 which flares outwardly from the longitudinal axis of the lantern 1 may be provided at the bottom of the base 3 of the lantern 1. Such skirt 51 may also include one or more openings (e.g., grills 53), which may alternatively or additionally serve as air inlets for the heater 9, as shown in FIG. 6.

Figure 7:
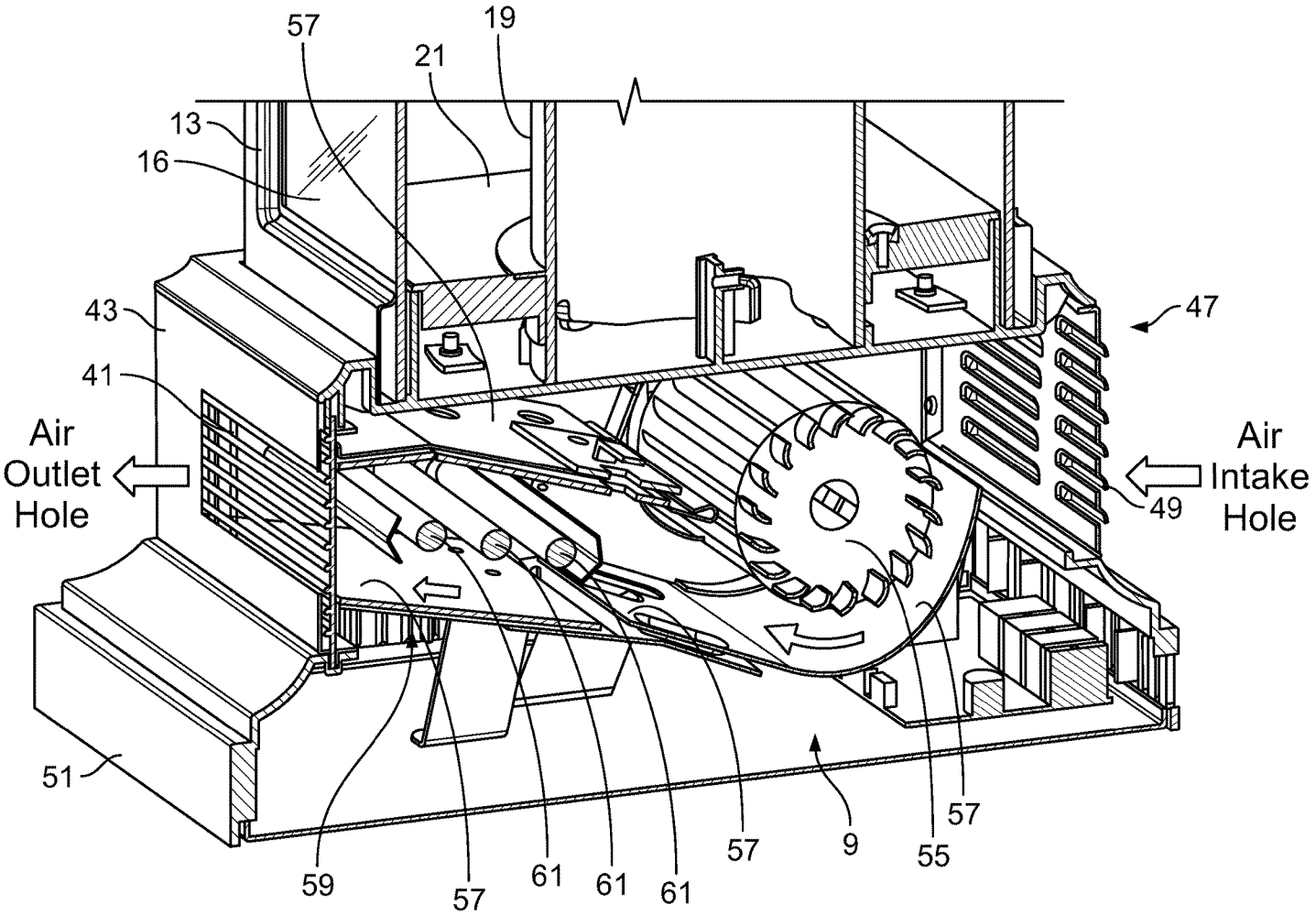
FIG. 7 is an enlarged sectional view of the base of the lantern of FIG. 1.

The internal construction of the base 3 of the lantern, including heater 9, is illustrated in FIG. 7. As shown in that figure, the heater 9 may include a fan for moving air between the intake grill 49 and the outlet grill 41. Such fan may be structured as a centrifugal fan or blower 55, as shown in FIG. 7. The heater may also include walls 57 for directing the air between the intake grill 49 and the outlet grill 41. Such walls 57 may define a heating section 59 including one or more heating elements 61 inside of it, such that the air passes in close proximity to the heating elements 61 before exiting the lantern 1 through the outlet grill 41. The heating elements 61 desirably supply heat to the air as the air moves past them. Such heating may be direct or indirect or a combination of both. For example, the air may heat up by making direct contact with the heated heating elements 61, and/or the heating elements 61 may heat surrounding components (e.g., the walls 57 of the heating section 59), which heated surrounding components heat the air as the air contacts them while moving by.

The heating elements 61 in the heater 9 may be any type of heating element capable of supplying sufficient heat energy to the air moving through the convection heater. For example, the elements 61 may include Nichrome or other similar material having a high resistance and heating up substantially when electric current passes through it. The elements 61 may alternatively be formed from or may include ceramic. The heating elements 61 may also be in the form of heat lamps, which supply heat energy primarily in the form of infrared radiation, which may, as discussed above, heat up the surrounding components (e.g., the walls 57 of the heating section 59), so as to indirectly heat the air passing through the heating section 59. In yet further embodiments, the air passing through the heater 9 may additionally or alternatively be heated by combustion of a fuel, such as natural gas, propane, oil, gasoline, kerosene, etc.

As discussed above, the heater 9 is desirably configured to supply sufficient heating energy to the area and/or people located around the lantern 1 to provide a pleasant warmth to that area and/or people. Moreover, the heater 9 preferably does so without emitting a substantial amount of visible light. For example, the heating elements 61 of the heater, although they may radiate electromagnetic energy (e.g., infrared radiation), preferably do not emit so much visible light that an area around the lantern can be substantially illuminated thereby. Alternatively, even if the heating elements 61 emit visible light, most of the heat energy radiated by the heating elements 61 is preferably outside of the visible light spectrum. It is noted that the visible light spectrum generally comprises wavelengths between about 380 and 700 nm. In one example, the heater 9 may be configured to supply at least 500 W of heating power. In another preferred embodiment, the heater 9 may be configured to supply at least 1000 W of heating power. In yet additional preferred embodiments, the heater 9 may be configured to supply about 1500 W of heating power (e.g., in the range of 1250 W to 1750 W), or more than 1750 W of heating power.

Figure 8:
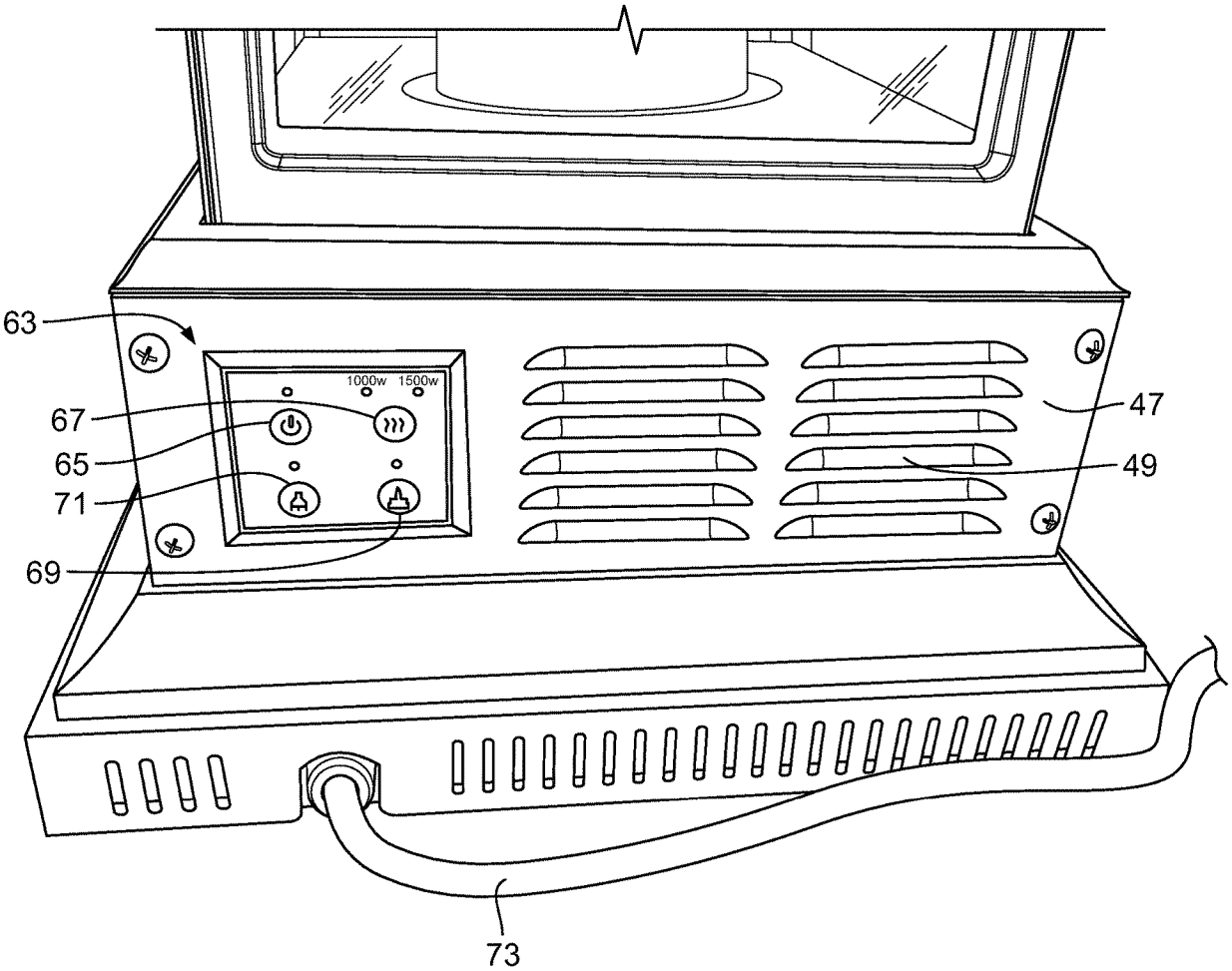
FIG. 8 is an enlarged rear view of the base of the lantern of FIG. 1.
Figure 9A:
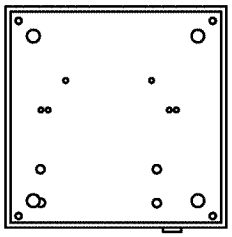
FIGS. 9A-F are bottom, top, front, right-side, left-side, and rear views, respectively, of the lantern of FIG. 1.
Figure 9C:
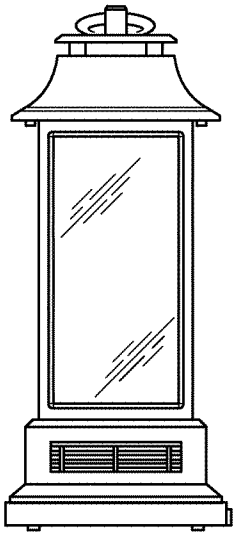
Figure 9E:
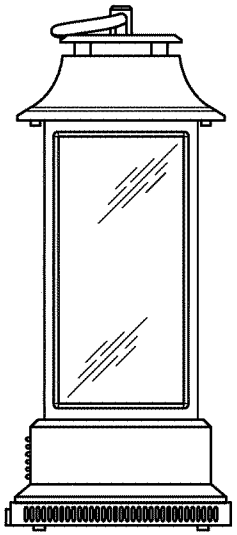
Figure 9F:
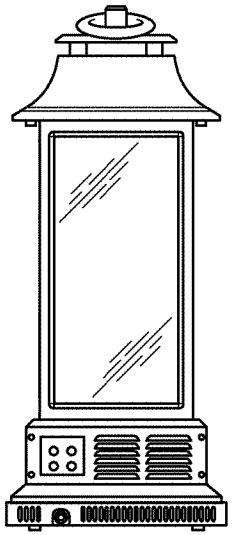
Figure 9B:
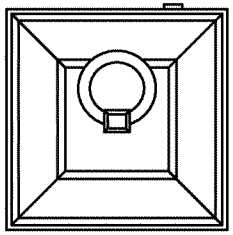
Figure 9D:
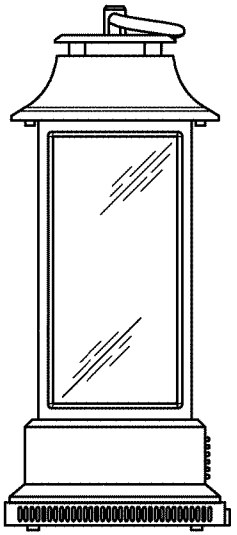
Figure 10A:
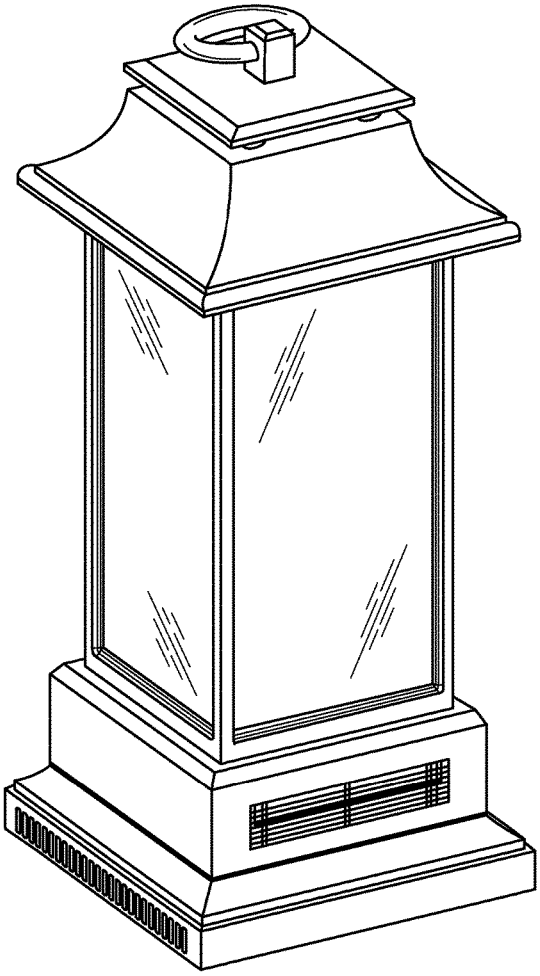
FIG. 10A is a front isometric view of the lantern of FIG. 1.
Figure 10B:
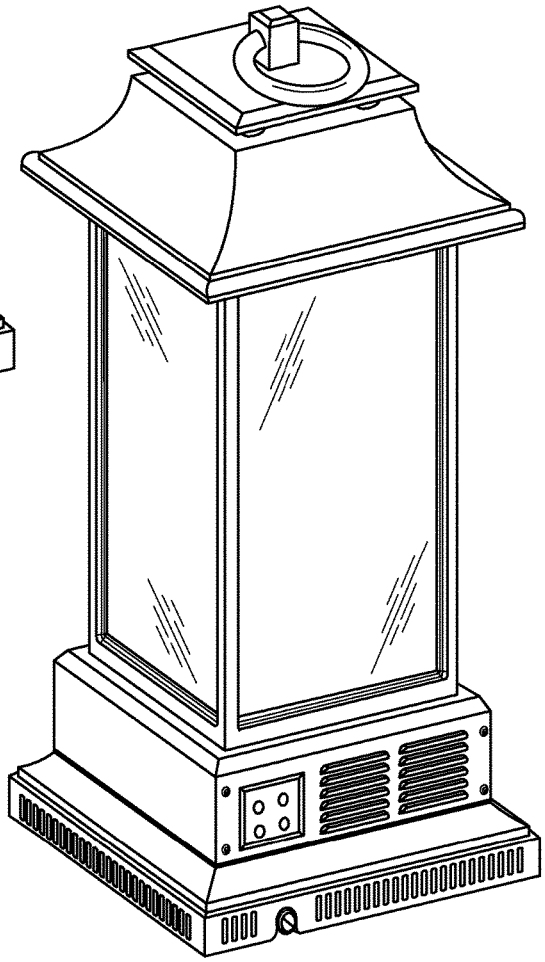
FIG. 10B is a rear isometric view of the lantern of FIG. 1.

The heater 9 and other components of the lantern 1 may be controlled by a control panel 63, which may be positioned on the rear face 47 of the lantern 1. For example, as shown in FIG. 8, the control panel 63 may include a power button 65 for turning on and off the power to the unit; a heater control button 67 for toggling between different heat settings for the heater (e.g., off, 1000 W, and 1500 W); a candle button 69 for controlling illumination of the artificial candle 19; and a lighting button 71 for controlling other lighting in the lantern 1 (e.g., the lights 22 below the bottom wall 21 of the lighting section 7 and/or the lights 27 in the top 5). In addition to, or instead of, the control panel 61 on the lantern housing, the various components of the lantern 1 may be controlled by a remote control.

The heater 9 and other components of the lantern 9 are preferably electrically powered. The power may be supplied through a cable 73 (e.g., one connected to the base 3 on the rear face 47 of the lantern 1, as shown in FIG. 8), which cable 73 may be plugged into an ordinary electrical socket. In another embodiment, the heater 9 and/or other components of the lantern 9 may be powered by batteries positioned within the lantern housing.

In an alternative embodiment of the invention (not shown), the heater 9 may be a radiant heater that supplies heating energy to the area and/or people located around the lantern 1 via radiant energy rather than heated air blowing through the unit. In such case, the one or more outlet openings may be replaced with structures (e.g., translucent windows) that permit radiant energy to emanate from the heating section 11 of the lantern 1. It is believed that a radiant heater may be more suitable for an outdoor version of the lantern 1, as it may be more difficult to supply adequate heat in an outdoor environment via a convection heater. Nevertheless, a convection heater may be used in an outdoor version of the lantern, and a radiant heater may be used in an indoor version of the lantern, and vice versa.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A lantern, comprising:

a housing comprising a top, a base, and an interior volume;

wherein the housing defines a heating section comprising a heater and a lighting section comprising the interior volume and an illumination section comprising a light source, wherein the illumination section is disposed beneath the interior volume;

wherein the illumination section is disposed above the heating section and is defined on its upper boundary by a lighting section wall and on its lower boundary by a heating section wall;

wherein the interior volume is defined on its upper boundary by a frame, on its lower boundary by the lighting section wall, and by a support extending between the heating section and the top;

wherein a candle is disposed within the interior volume;

wherein the light section wall comprises an upper portion facing the interior volume and an opposite lower portion facing the illumination section;

wherein the light source is disposed beneath the lighting section wall and exterior to the candle and operatively at least partially illuminates upward through the lighting section wall.

2. The lantern of claim 1, wherein the heating section operatively directs heat from the heater outward from the lantern.

3. The lantern of claim 2, wherein the heater is a convection heater.

4. The lantern of claim 1, wherein the top is removably attached to the frame by a fastener.

5. The lantern of claim 1, wherein the top is removably attached to the frame by a hinge.

6. The lantern of claim 1, wherein the frame comprises an opening to the interior volume.

7. The lantern of claim 1, wherein the opening to the interior volume is covered when the top is operatively attached to the frame.

8. The lantern of claim 1, wherein the opening to the interior volume is uncovered when the top is at least partially detached from the frame.

9. The lantern of claim 1, wherein a second light source is positioned within the interior volume of the housing.

10. The lantern of claim 1, wherein the interior volume permits visible light from light source to emanate from the interior volume through at least one aperture defined by the support.

11. The lantern of claim 1, wherein the lighting section wall is at least partially translucent.

12. The lantern of claim 1, wherein the interior volume is configured to receive decorative items.

13. The lantern of claim 1, wherein a second light source is disposed beneath a lower portion of the frame and at least partially illuminates downward.

* * * * *